United States Patent [19]

Matsuo

[11] 4,249,055

[45] Feb. 3, 1981

[54] PUSH BUTTON SWITCH

[75] Inventor: Katsuyuki Matsuo, Iwaki, Japan

[73] Assignee: Alps Electric Co., Ltd., Tokyo, Japan

[21] Appl. No.: 41,814

[22] Filed: May 23, 1979

[30] Foreign Application Priority Data

May 25, 1978 [JP] Japan ..... 53/70879[U]

[51] Int. Cl.[3] ..... H01H 3/12; H01H 5/20

[52] U.S. Cl. ..... 200/159 B; 200/67 DB; 200/340

[58] Field of Search ..... 200/159 B, 67 D, 159 A, 200/329, 340, 67 DB

[56] References Cited

U.S. PATENT DOCUMENTS

| | | | |
|---|---|---|---|
| 3,133,170 | 5/1964 | Nanninga | 200/159 B |
| 3,674,970 | 7/1972 | Bedocs | 200/168 C |
| 3,773,998 | 11/1973 | Seeger et al. | 200/159 B |
| 3,924,090 | 12/1975 | Chao et al. | 200/159 A |
| 3,969,600 | 7/1976 | Sims, Jr. | 200/159 B |
| 4,150,272 | 4/1979 | Bruun et al. | 200/159 A |

FOREIGN PATENT DOCUMENTS

| | | | |
|---|---|---|---|
| 2360168 | 6/1975 | Fed. Rep. of Germany | 200/67 DB |

*Primary Examiner*—Willis Little

*Attorney, Agent, or Firm*—Guy W. Shoup; Gerard F. Dunne

[57] ABSTRACT

A push button switch having a plurality of fixed terminals and an inversion leaf spring opposing to the fixed terminals and adapted to be actuated by actuator levers pivotally supported by two switch blocks juxtaposed with each other to extend in parallel with the direction of movement of the switch levers so that a depressing force of the switch levers actuates these two switch levers.

5 Claims, 12 Drawing Figures

PUSH BUTTON SWITCH

BACKGROUND OF THE INVENTION (1) Field of the Invention

This invention relates to a push button switch and, more specifically, to a push button switch suitable for use in a terminal machine of a computer or in an electric typewriter.

(2) Description of the Prior Art

General reference is made to the applicant's copending application U.S. Ser. No. 973,422 filed Dec. 26, 1978.

Generally speaking, push button switches of this kind has, as disclosed in U.S. Pat. No. 3,969,600, an inversion leaf spring made of a thin plate of beryllium copper or the like material disposed on a bottom surface in a horizontal plane. In operation, the inversion leaf spring is inversed as it is depressed vertically by a depression of a key top, thereby bringing a movable contact into contact with a fixed contact and turning the switch on. However, the push button switch of this kind has disadvantages such as a limited stroke of the keytop. In addition, the contact mechanism is so weak that it may be broken by a large depressing force applied to the key top.

In order to avoid the breakage of the contact mechanism, U.S. Pat. No. 3,773,998 discloses a push button switch using a coiled spring. However, this push button switch fails to provide sufficiently distinctive feel of actuation to the user of the switch.

SUMMARY OF THE INVENTION

It is therefore an object of the present invention to provide a push button switch capable of affording a light switching operation and a distinctive feel to the user of the switch.

It is another object of the present invention to provide a push button switch incorporating two switch blocks in a frame body whereby actuation of only one switch lever enables the change over of the two switch blocks sequentially.

It is still another object of the present invention to provide a push button switch capable of varying an operating force of one of the two switch blocks from that of the other.

DESCRIPTION OF THE PREFERRED EMBODIMENT

Figure 1:
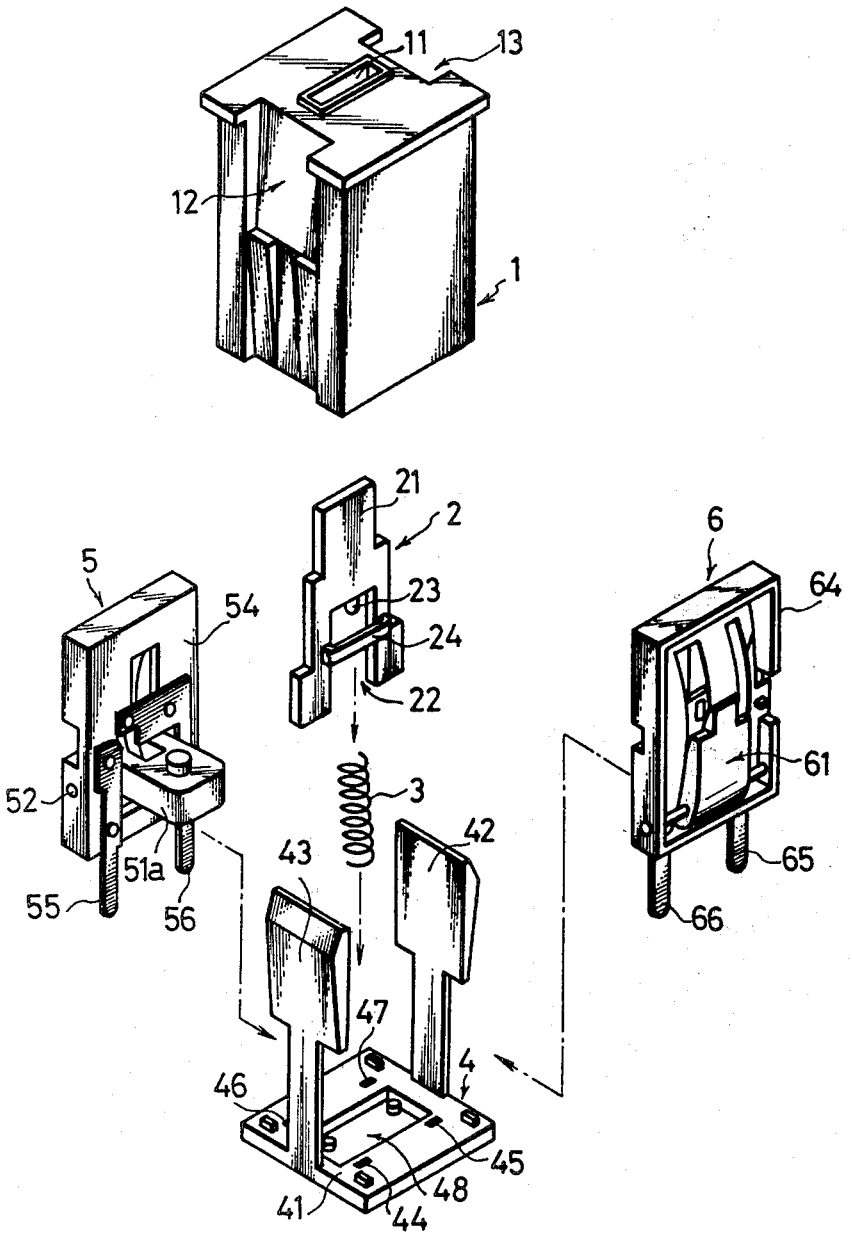
FIG. 1 is an exploded perspective view of an embodiment of the present invention.

Referring initially to FIG. 1 which is an exploded perspective view of an embodiment of the present invention, a case 1 is shown provided with a slit 11 formed on its upper surface as well as a pair of retaining grooves 12, 13 on the right and left side, respectively. A switch lever 2 is provided at its upper end with a projection 21 to which a push button is to be fitted, and at its lower portion, with a groove 22. The switch lever further includes a spring retaining portion 23 formed at the upper end of the groove 22 and an actuating projection 24 formed at its one side. Reference numerals 3 and 4 represent a coiled spring and a lower case, respectively. Retaining tabs 42 and 43 are formed at respective sides of a bottom plate 41 of the lower case. The bottom plate 41 is provided with rectangular bores 44 to 47 to receive terminals of two contact mechanisms noted below and with a central recess 48. Reference numerals 5 and 6 represent contact mechanism adapted to perform different switching actions from each other. The construction of these contact mechanisms will be described later in more detail.

Figure 2:
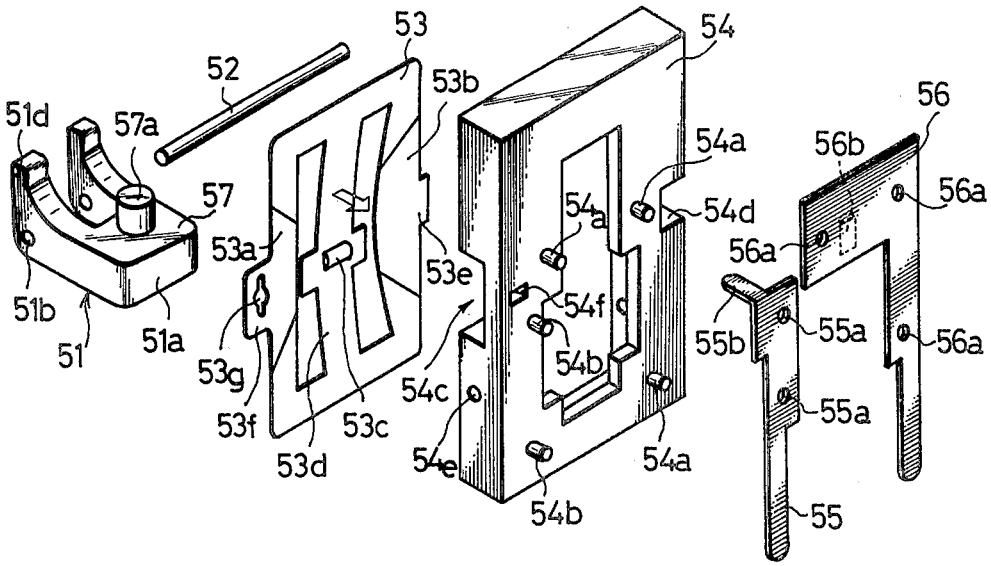
FIGS. 2 and 4 are exploded perspective views of the contact mechanism thereof.

As shown in FIG. 2, the first contact mechanism 5 has a tact lever 51, shaft 52, inversion leaf spring 53, frame 54, first terminal 55 on the moving side and second terminal 56 on the stationary side. The tact lever 51 consists of legs 15*d*, a bore 5 1*b* and a back portion 51*a*. The inversion spring 53 is made of a thin plate of beryllium copper, and has frame portions 53*a*, 53*b*, movable contact 53*c*, movable plate 53*d*, tab 53*c* and a tab 53*f* provided with a bore 53*g*. In press-forming the inversion leaf spring 53, the frame portions 53*a* and 53*b* are so bent that the movable plate 53*d*, to which the movable contact is attached, is bent in an arcuate form. When the movable plate 53*d* is pressed and moved in the direction indicated by the arrow by a predetermined distance, not only the movable plate 53*d* but the inversion leaf spring as a whole cause inversion. At the time of this inversion, a distinctive click sound is generated by the movable plate 53*d*. When the movable plate 53*d* is released from the depressing force, it comes to resume the original position, thereby making a click sound similary. The frame 54 is provided with projections 54*a*, 54*b*, recesses 54*c*, 54*d*, a bore 54*e* and a rectangular bore 54*f*. The first terminal 55 of the moving side has a small bore 55*a* and a bent end 55*b* while the second terminal 56 on the stationary side has a small bore 56*a* and a fixed contact 56*b*.

The contact mechanism 5 is assembled in the following manner. At first, the second terminal 56 on the stationary side is attached to the frame 54 by inserting the projection 54*a* of the frame 54 into the small bore 56*a* and then heat-deforming the end of the projection 54*a*. At the same time, the first terminal 55 on the moving side is attached to the frame 54 by inserting the projection 54*b* of the frame into the small bore 55*a* of the first terminal 55 and the bent end 55*b* into the rectangular bore 54*f* of the frame 54, respectively, and then heat-deforming the end of the projection 54*b*.

Subsequently, the tabs 53*e* and 53*f* of the inversion leaf spring 53 are fitted into the recesses 54*c* and 54*d* of the frame 54. In this instance, the end 55*b* of the first terminal 55 on the moving side, which projects into the recess 54*c*, is made to pass through the bore 53*a* of the tab 53*f*. Then, the end 55*b* is bent or twisted so that the inversion leaf spring 53 and the first terminal 55 on the moving side are electrically connected to each other.

Next, after inserting the legs 51*d* of the tact lever 51 into the slit between the frame portions 53*a*, 53*b* and the movable plate 53*d* of the inversion leaf spring 53, the shaft 52 is inserted into the bore 54*e* of the frame 54 and into the bore 51*b* of the tact lever 51, thereby to pivotally attach the tact lever 51 to the frame 54.

Figure 3A:
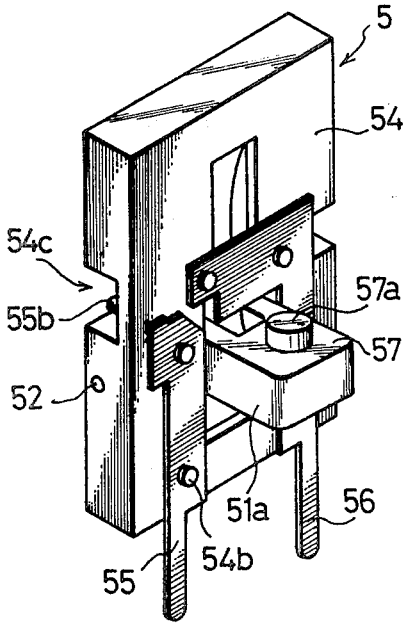
FIGS. 3A, 3B, 5A, 5B, 6A, 6B and 6C are perspective views of the contact mechanism thereof.
Figure 3B:
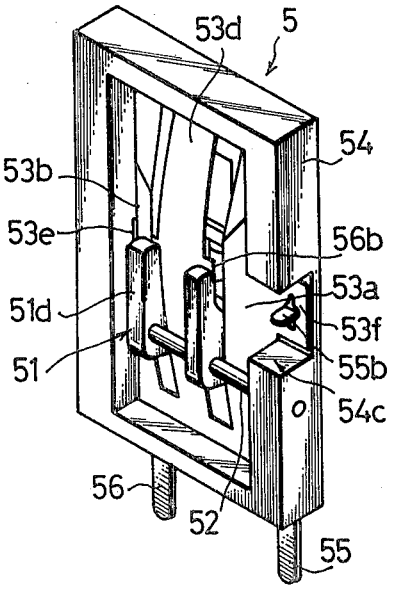

Incidentally, FIGS. 3A and 3B are perspective views of the contact mechanism 5 in the assembled state, as viewed from the front and rear side, respectively.

Figure 4:
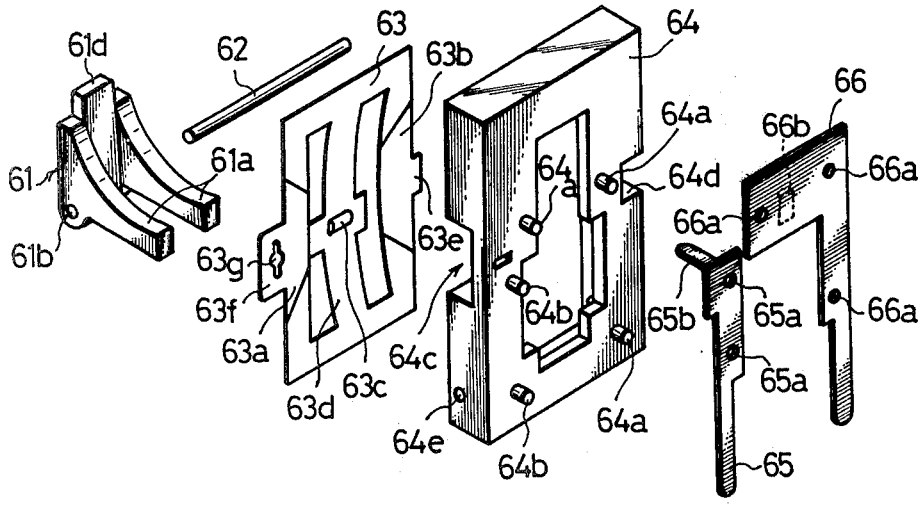

As shown in FIG. 4, the second contact mechanism 6 has substantially the same basic construction as the first contact mechanism 5 except that the shape of the tact lever 61 and the fitting position of the shaft 62 are different. In other words, in comparison with the aforementioned tact lever 51, the legs 61*a* of the tact lever 61 are shorter while its back portion 61*d* is longer. Hence, the bore 61*a* of the tact lever 61 is bored more downwardly than the bore 51*b* of the tact lever 51, and is pivotally supported by the shaft 62. The shapes and the materials forming the frame 64, the first terminal 65 on the moving side, the second terminal 66 on the stationary side and the inversion leaf spring 63 are the same as those of the aforemention members forming the first contact mechanism 5 and hence, their methods of assembly also are exactly the same.

Figure 5:
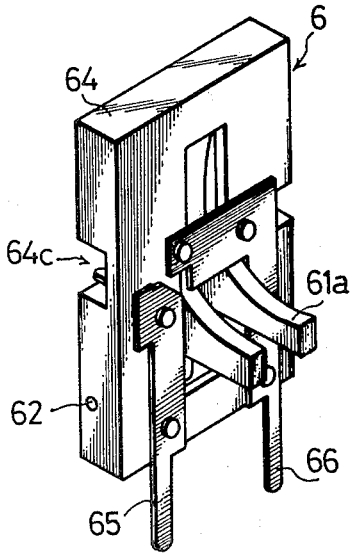
Figure 5:
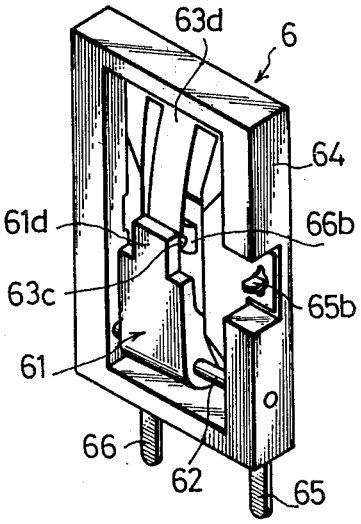
Figure 6:
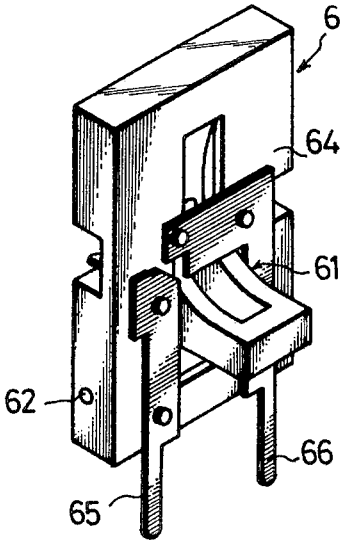
Figure 6:
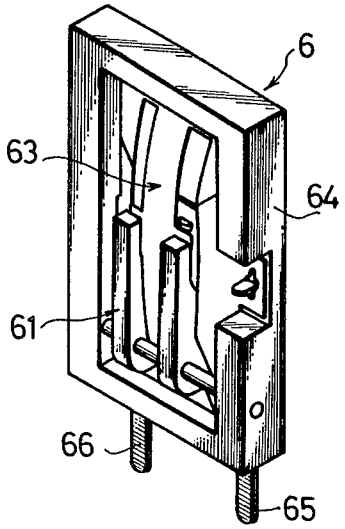
Figure 6:
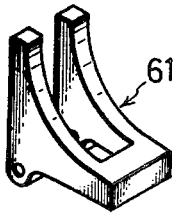

FIGS. 5A and 5B are perspective views of the contact mechanism 6 in the assembled state, as viewed from the front and rear side, respectively. Incidentally, FIGS. 6A and 6B are perspective views of another embodiment of the contact mechanism 6 wherein the tact lever 61 has a shape such as shown in FIG. 6C.

Next, the explanation will be given on the assembly of the push button switch of the invention with reference to FIG. 1. First, the first terminal 55 on the moving side and the second terminal 56 on the stationary side of the first contact mechanism 5 are made to pass through the rectangular bores 46 and 47 of the bottom plate 41 of the lower case 4, respectively, and are caulked onto the lower face of the bottom plate 41 thereby to fasten the first contact mechanism 5 to the lower case 4. Similarly, after the first terminal 65 on the moving side and the second terminal 66 on the stationary side of the second contact mechanism 6 are made to pass through the rectangular bores 44 and 45 of the bottom plate 41 of the lower case 4, respectively, they are caulked onto the lower face of the bottom plate 41 thereby to fasten the second contact mechanism 6 to the lower case 4.

Subsequently, the coiled spring 3 is placed on the spring retainer 57 of the first contact mechanism 5 provided with the projection 57*a* and is fitted into the slit 22 of the lever 2. In this case, the spring retaining portion 23 at the uppermost end of the groove 22 engages with the upper end of the coiled spring 3. Finally, the case 1 is put to the lower case 4 so as to engage the retaining tabs 42 and 43 of the lower case 4 with the retaining grooves 12 and 13 of the case 1, respectively. In this instance, the projection 21 of the lever 2 protrudes outward from the slit 11 of the case 1.

Figure 7:
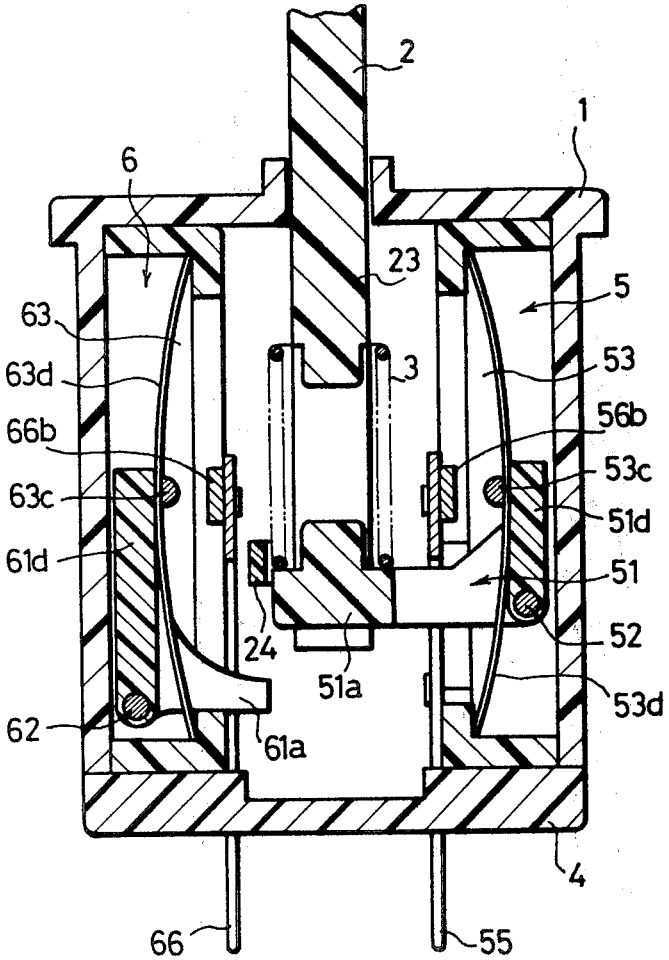
FIG. 7 is a sectional view thereof.

FIG. 7 is a sectional view of the push button switch after its assembly is completed.

Next, the push button switch of the invention functions in the following manner.

When the projection 21 of the lever 2 is pushed downward, the coiled spring 3 is compressed and its depressing force is transmitted to the tact lever 51, thereby depressing it down. Accordingly, the depressing force is applied to the movable plate 53*d* of the inversion leaf spring 53 via the tact lever 51. However, until the depressing force attains a predetermined value, only the coiled spring 3 is compressed and the inversion leaf spring 3 does not cause inversion.

When the depressing force of the back portion 51*d* of the tact lever 51 acting on the movable plate 53*d* of the inversion leaf spring 53 exceeds a predetermined value required for causing inversion of the inversion leaf spring 53, the inversion leaf spring 53 causes inversion while generating a click sound and transmits a feel of a light click to the finger of an operator of the push button switch whereby the movable contact 53*c* and the fixed contact 56*b* are brought into mutual contact and the first contact mechanism 5 is turned on.

The coiled spring 3 starts extending as the depressing force of the lever 2 starts being released. However, the lever 2 merely ascends but the inversion leaf spring 53 is kept in the inversed state until the depressing force of the back portion 51*d* of the tact lever 51 acting on the movable plate 53*d* of the inversion leaf spring 53 weakens to such a point where the inversion leaf spring 53 is allowed to resume its original position. When the depressing force of the movable plate 53*d* weakens down to a predetermined value, the inversion leaf spring 53 resumes its original position while generating again the click sound and transmits the feel of a light click to the finger of the operator whereby the movable contact 53*c* is separated from the fixed contact 56*b* and the first contact mechanism 5 is turned off.

Figure 8:
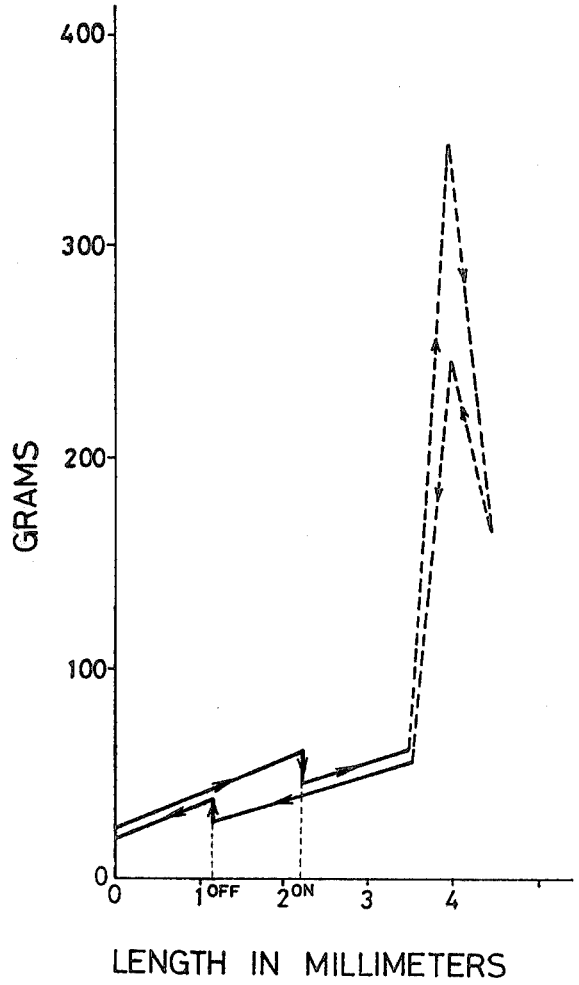
FIG. 8 is a drawing useful for explaining the operation of the push button switch of the present invention.

The action of the abovementioned contact mechanism 5 in the first operation zone has a lever position at the time of switching-on which is different from a lever position at the time of switching-off due to the combination of the coiled spring 3 and the inversion leaf spring 53. In other words, the contact mechanism 5 performs a so-called hysteresis action. The full line portion in FIG. 8 represents this hysteresis action.

After, in switching the contact mechanism 5 on by pushing the lever 2, if the lever 2 is strongly pushed further without loosening the operating force to the lever 2, the actuating projection 24 provided to one side of the lever 2 pushes down the legs 61*a* of the tact lever 61 of the second contact mechanism 6 as well as the movable plate 63*d* of the inversion leaf spring 63 via the tact lever 61 so that the inversion leaf spring 63 causes inversion while generating a click sound and transmits the feel of a light click to the finger of the operator whereby the movable contact 63*c* and the fixed contact 66*a* are brought into mutual contact and the second contact mechanism 6 is turned on.

When the strong depressing force applied to the lever 2 is released, the inversion leaf spring 63 again generates a click sound, resumes its original position and transmits the feel of a light click to the finger of the operator whereby the movable contact 63*c* is separated from the fixed contact 66*b* and the second contact mechanism 6 is turned off. In FIG. 8, the dot-line portion represents the second operation zone of the push button switch of the present invention which is useful for explaining the action of the second contact mechanism 6 to be turned on and off in this second operation zone.

As explained in detail in the foregoing paragraph, the push button switch of the present invention includes two contact mechanisms of a flat plate shape disposed in parallel with the moving direction of the lever so that one of the contact mechanisms can be positioned on one side of the lever and the other mechanism on the other side.

Since the operating force applied to the lever is transmitted to the movable contact via the coiled spring, the switching operation of the push button switch is extremely light so that the operator of the push button switch feels less fatigue even in the continuous operation of the switch in a number of times. As the push button switch is provided with the hysteresis action, it is possible to prevent wrong action of the push button switch and to perform the reliable switching operation.

Further, the lever position for actuating one of the contact mechanisms is different from that for actuating the other and the operating force of the second contact mechanism is by far greater than that of the first contact mechanism. According to this arrangement, it is possible to operate the two circuits by one lever separately and reliably. The operating force can be made, for example, 50–70 g for the first contact mechanism and 350–500 g for the second contact mechanism.

In the push button switch of the present invention, therefore, it is also possible to use of the contact mechanisms for a printing key of an electric typewriter and the other for repeating operation.

What is claimed is:

1. A push button switch comprising:

a frame; a switch lever; a first switch block accomodated by said frame and including (a) a carrier plate, (b) an inversion leaf spring member made of an electrically conductive material and secured to said carrier plate so as to extend in parallel with the direction of movement of said switch lever, (c) first and second terminals fixed to said carrier plate and adatped to be electrically connected to each other by said inversion leaf spring member, and (d) an actuator lever pivotally secured to said carrier plate and adapted to press said inversion leaf spring member in response to the movement of said switch lever;

a second switch block accomodated by said frame and including (a) a second carrier plate, (b) a second inversion leaf spring member made of an electrically conductive material and secured to said second carrier plate so as to extend in parallel with the direction of movement of said switch lever, (c) third and fourth terminals fixed to said second carrier plate and adapted to be electrically connected to each other by said second inversion leaf spring member, and (d) a second actuator lever pivotally secured to said second carrier plate and adapted to press said second inversion leaf spring member in response to the movement of said switch lever, said second actuator lever being positioned downwardly from said actuator lever of said first switch block, and a coiled spring interposed between said switch lever and said actuator lever of said first switch block.

2. The push button switch as defined in claim 1 wherein said switch lever is interposed between said first switch block and said second switch block inside said frame.

3. The push button switch as defined in claim 1 wherein, when said switch lever is depressed, said first switch block is a actuated at first and said second switch block is then actuated.

4. The push button switch as defined in claim 3 wherein said first and said second switch blocks are so constructed that their operating forces are different from each other.

5. The push button switch as defined in claim 4 wherein the operating force of said second switch block is greater than that of said first switch block.

* * * * *